US011292050B1

(12) United States Patent
Spilker

(10) Patent No.: US 11,292,050 B1
(45) Date of Patent: Apr. 5, 2022

(54) HYDRAULIC FASTENER TOOL

(71) Applicant: Mark Spilker, Reno, NV (US)

(72) Inventor: Mark Spilker, Reno, NV (US)

( * ) Notice: Subject to any disclaimer, the term of this patent is extended or adjusted under 35 U.S.C. 154(b) by 229 days.

(21) Appl. No.: 16/785,350

(22) Filed: Feb. 7, 2020

Related U.S. Application Data

(60) Provisional application No. 62/802,810, filed on Feb. 8, 2019.

(51) Int. Cl.

| | |
|---|---|
| ***B21J 15/20*** | (2006.01) |
| ***B21J 15/30*** | (2006.01) |
| ***B21J 15/10*** | (2006.01) |
| ***B21J 15/32*** | (2006.01) |
| *B21J 15/02* | (2006.01) |
| *B21J 15/04* | (2006.01) |

(52) U.S. Cl.
CPC ..... *B21J 15/20* (2013.01); *B21J 15/105* (2013.01); *B21J 15/30* (2013.01); *B21J 15/022* (2013.01); *B21J 15/045* (2013.01); *B21J 15/326* (2013.01)

(58) Field of Classification Search
CPC ..... B21J 15/022; B21J 15/043–15/045; B21J 15/105; B21J 15/20; B21J 15/30; B21J 15/326
See application file for complete search history.

(56) References Cited

U.S. PATENT DOCUMENTS 2,527,307 A * 10/1950 Huck ..... B21J 15/045 72/370.01
2,531,048 A * 11/1950 Huck ..... F16B 19/05 411/361
3,107,806 A * 10/1963 Van Hecke ..... B21J 15/045 29/243.522
3,215,024 A * 11/1965 Brilmyer ..... B21J 15/022 411/361
3,605,478 A * 9/1971 Chirco ..... B21J 15/045 29/243.529
3,645,125 A * 2/1972 Summerlin ..... B21J 15/022 29/243.522
5,060,359 A * 10/1991 Muir ..... B21J 15/022 29/244
5,146,773 A * 9/1992 Rosier ..... B21J 15/022 29/243.522
5,208,958 A * 5/1993 Wilcox ..... B21J 15/022 29/243.522
5,519,926 A * 5/1996 Rosier ..... B21J 15/022 29/243.523
5,598,619 A * 2/1997 Rosier ..... B21J 15/022 29/243.523
6,182,345 B1 * 2/2001 Travis ..... B21J 15/043 29/243.521
2006/0090318 A1 * 5/2006 Toosky ..... B21D 39/032 29/243.518
2008/0184545 A1 * 8/2008 Cobzaru ..... B21J 15/045 29/243.529
2012/0030918 A1 * 2/2012 DeSalvo ..... B21J 15/045 29/283

(Continued)

*Primary Examiner* — Matthew P Travers

(74) *Attorney, Agent, or Firm* — Adams Law Office; Sharon Adams

(57) ABSTRACT

A hydraulic fastener tool comprising with a piston in threaded connection with a single-unit puller that is inside a single-unit anvil. Inside the puller is a segmented collet assembly with an internal spring and guide tube. In use, the tool secures fasteners and ejects the severed fastener stem after fastening.

13 Claims, 5 Drawing Sheets

(56) References Cited

U.S. PATENT DOCUMENTS

| | | | | |
|---|---|---|---|---|
| 2013/0212849 | A1* | 8/2013 | Soller | B21J 15/043<br>29/243.521 |
| 2014/0250649 | A1* | 9/2014 | Masugata | B21J 15/30<br>29/243.54 |
| 2015/0273569 | A1* | 10/2015 | Lin | B21J 15/22<br>29/243.54 |
| 2016/0107224 | A1* | 4/2016 | King | B21J 15/30<br>72/453.17 |
| 2018/0126446 | A1* | 5/2018 | Mori | B21J 15/043 |
| 2019/0013763 | A1* | 1/2019 | Woyciesjes | H02P 29/40 |
| 2019/0247913 | A1* | 8/2019 | Lian | B21J 15/105 |
| 2020/0139424 | A1* | 5/2020 | Yabuguchi | B21J 15/32 |

* cited by examiner

HYDRAULIC FASTENER TOOL

CROSS REFERENCE TO RELATED APPLICATION

This application is a continuation-in-part of U.S. patent application No. 62/802,810 filed on Feb. 8, 2019, which is incorporated herein in its entirety.

STATEMENT REGARDING FEDERALLY SPONSORED RESEARCH

Not applicable.

NAMES OF THE PARTIES TO A JOINT RESEARCH AGREEMENT

Not applicable.

STATEMENT REGARDING PRIOR DISCLOSURES

Not applicable.

BACKGROUND OF THE INVENTION

At construction sites, and in other places, there is a need for a hydraulically-powered tool to fasten rivets, which are frequently called "fasteners". These tools are often used to fasten at least two work pieces together using rivets/fasteners. The fasteners have a head and a stem and are inserted through the work pieces. Existing tools grasp the stem of a fastener, pull the stem into the tool body thereby "mushrooming" the head of the fastener and securing the work pieces together. The stem of the fastener breaks and is propelled into the body of the tool.

Existing devices frequently jam, and often need cleaning because flakes from the fasteners interfere with smooth operation of existing tools. In addition, existing tools have no method to extrude the secured fastener after the work pieces are fastened. The lack of ability to extrude secured fasteners means that the operator must take the time to do this, and slows down work flow when using existing tools for a series of fasteners.

BRIEF SUMMARY OF THE INVENTION

The invention is a tool for quickly installing fasteners, ejecting severed fastener stems, and also pushing the fastened workpiece with fastener out and away from the tool after use. This allows work to proceed more quickly and efficiently, saving time on the job because the operator does not need to remove the fastener or the fastener stem. In addition, the tool prevents defective fasteners from being pulled into the tool.

The tool comprises a hydraulically powered tool with a handle and trigger for actuating the tool, a body, a piston, and a nose assembly comprising an anvil, a puller with a neck, and a collet assembly with an internal spring and guide hose.

In preferred embodiments, the collet assembly 600 comprises four separate segments bound by at least one o-ring 635. Each segment has an inside surface with a circumference and an outside surface with a circumference. The inside surface of each segment has three sections, a jaw section 623, a guide section 622, and a spring section 621. When bound together by o-ring 635, the curved inside surfaces of the four segments form a segmented circle or circumference. The curved inner surfaces of the jaw sections form a segmented circumference that is capable of receiving a stem of a fastener, the curved inner surfaces of the guide tube sections form a segmented circumference that is capable of receiving a guide tube 651, and the curved inner surfaces of the spring sections form a segmented circumference that is capable of receiving a spring 530.

When the collet is assembled, an internal spring 530 fits within the circumference defined by a curved inner surface of the segmented collet. The internal spring has a nose end and a piston end, with the nose end resting on a rim 636 between the spring section and the guide tube section inside the collet. The internal spring 530 runs internally along the length of the collet and beyond the end of the collet, and rests on or near the piston head.

Inside the spring is a guide tube 651 that guides severed fastener stems 21 through the nose assembly.

The collet assembly is moveably disposed within a single-unit puller 500. The puller is in threaded connection with the piston 14. Puller 500 further comprises a small bump 505 that creates resistance in the case of rivet/fastener failure. Bump 505 prevents a broken fastener from being pulled into the tool.

The collet assembly is capable of moving within the single-unit puller. The uncompressed spring maintains the collet assembly in a forward position, toward the nose end. When a fastener stem is inserted into the collet jaws, the spring compresses and allows the collet assembly to move back from the nose end toward the piston end. This allows the collet assembly segments to expand into bulge 522 and open up to receive the fastener stem 21 into the collet assembly jaws, making it easier to insert the fastener stem into the tool. After receiving the fastener stem, the spring pushes the collet assembly forward toward the nose end.

The collet assembly and puller are disposed so that when actuated, the piston pulls the puller back, and the collet assembly is also pulled back. However, as noted above, the collet assembly can move back within the puller, even if the puller does not move back to accommodate receiving the stem of a fastener.

The puller is moveably disposed within the anvil 400, and the anvil is securely and removably connected with a collar 15 that is connected with the body 13 of the tool.

In operation, the nose end of the anvil rests on a workpiece, the collet jaws grip a fastener stem 21, the tool is activated, and high-pressure hydraulic fluid fills one chamber, causing the piston 14 to pull back, pulling the puller and collet assembly away from the head of the anvil. Once sufficient force is exerted the fastener stem 21 breaks and the force released by breaking the stem causes the spring to compress and move backward. The broken stem moves through the collet assembly via the guide tube 651 to a hollow passageway 16 inside the piston 14. Ultimately the fastener stem is disposed of outside the tool.

The hydraulic liquid moves into another chamber and the puller 500 moves forward to its resting position. As the puller moves forward toward the nose of the tool, the puller neck 525 pushes the fastened workpiece with fastener 20 out and away from the tool.

The rapid rearward ejection of the fastener stem 21, combined with the automatic ejection of the fastened workpiece and fastener 20 provide for efficient and cost-effective fastening, which is useful in many situations including solar panel installation.

BRIEF DESCRIPTION OF THE SEVERAL VIEWS

DETAILED DESCRIPTION OF THE INVENTION

Figure 1:
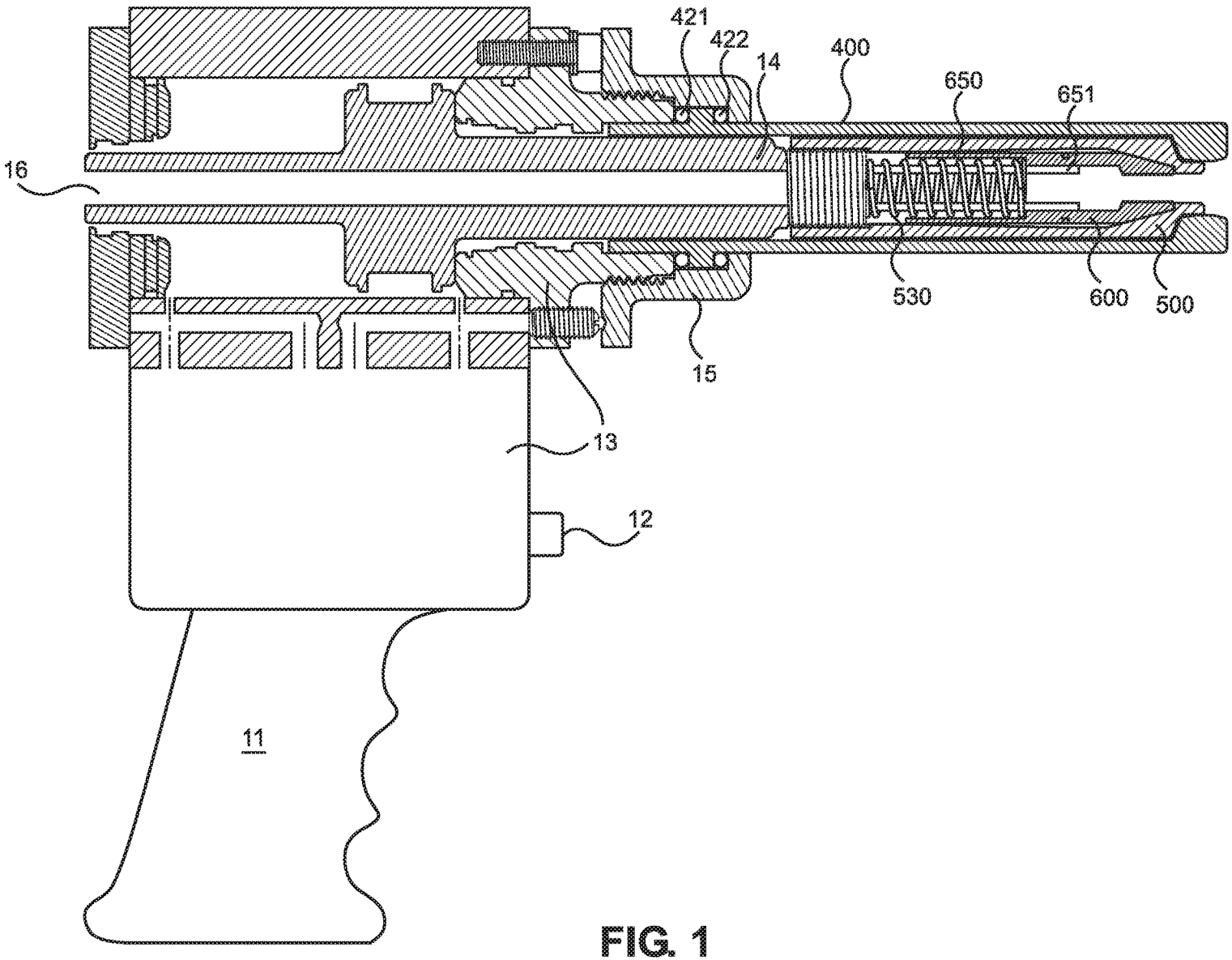
FIG. 1 is a cross section of the tool in the resting position, with the uncompressed spring pushing the collet assembly toward the nose end of the tool.

The invention is a tool for quickly installing fasteners comprising a hydraulically powered tool 10 with a handle 11, trigger 12 for actuating the tool, body 13, piston 14, and a nose assembly comprising an anvil 400, a puller 500, and a collet assembly 600 with an internal spring 530 and guide tube 651.

Figure 4:
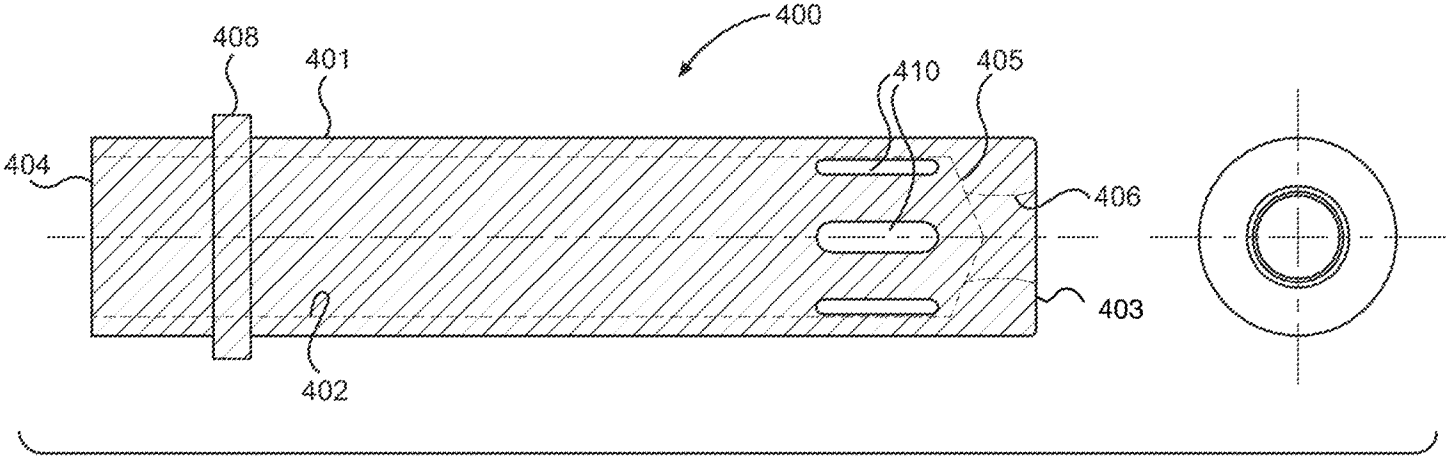
FIG. 4 is an exterior view of the anvil, along with a front end view of the nose of the anvil, with dotted lines showing an interior cross sectional view.

As shown in FIG. 4, anvil 400 is comprised of a cylindrical tube with an outside surface 401 with an external circumference, and an inside surface 402 with an internal circumference. Outside surface 401 has ridge 408 with a top surface and two sides surfaces. The ridge 408 projects from outside surface 401 of anvil 400 and is positioned near the piston end 404 of the anvil. A first o-ring 421 surrounds the outside surface of the anvil and is adjacent to a first side surface of the ridge. A second o-ring 422 surrounds the outside surface of the anvil and is adjacent to a second side of the ridge.

The anvil o-rings, the ridge, and the external circumference of the anvil are sized to fit within, and are configured in mating engagement with, a retaining collar 15.

The anvil o-rings provide dampening action needed to deal with the massive forces released by using the tool. The force will compress the anvil o-rings. Upon pulling trigger, after the fastener stem 21 breaks, the anvil jerks back and the anvil o-rings dampen the released forces.

Outside surface 401 of anvil is cylindrical and, except for the projecting ridge 408, is the same external diameter from the nose end 403 to the piston end 404 of the anvil. In a preferred embodiment, a plurality of longitudinal slots 410 are positioned near the nose end of the anvil. Longitudinal slots 410 allow dirt, debris, metal flakes, and wax on surface of fastener to escape, thereby causing less wear and tear on the tool.

The piston end 404 of anvil 400 has an annular opening so that anvil 400 is a hollow cylinder with a continuous internal diameter forming inside surface 402 from the piston end past longitudinal slots 410, whereupon the cylinder has an inward slope 405 to collar 406. The inside diameter of collar 406 is sized for mating engagement with the outside of neck 512 of puller 500.

Figure 5:
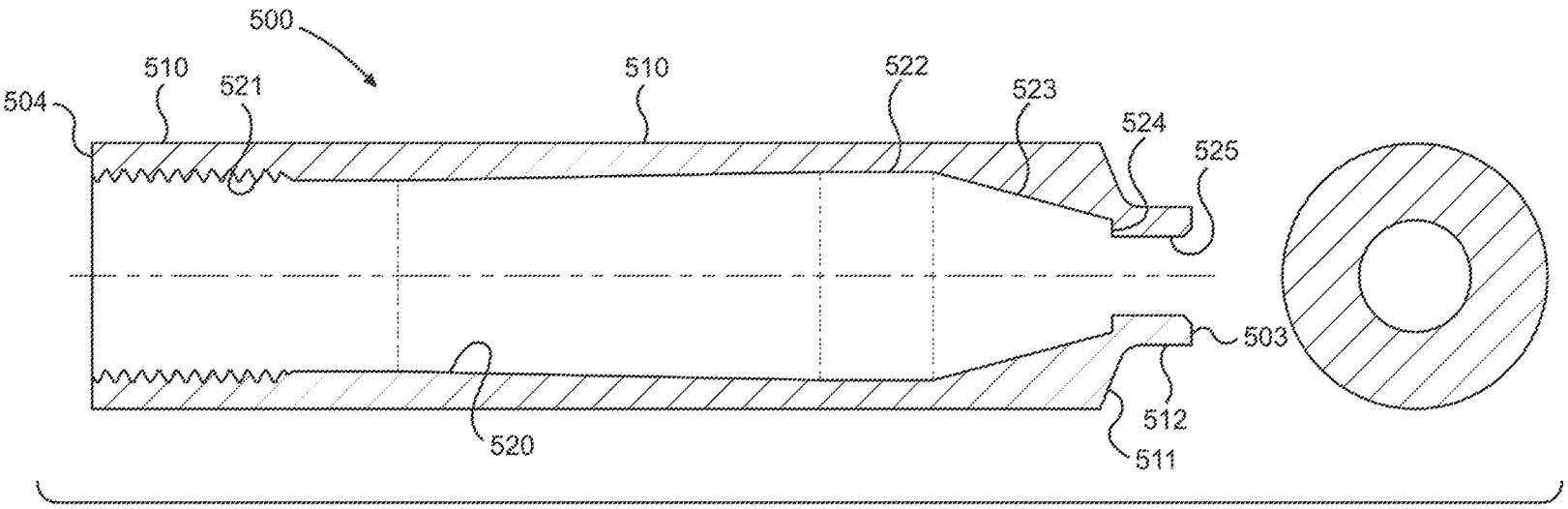
FIG. 5 is a cross section view of the puller, along with a front end view of the nose of the puller.

Puller 500 fits inside anvil 400. FIG. 5 shows puller 500, which comprises a hollow core with a nose end 503, a piston end 504, an outside surface comprised of a cylinder 510, a shoulder 511, and a neck 512, and an inside surface 520. The inside surface 520 defines the core of puller 500.

Outside surface cylinder 510 of puller 500 has a diameter that is sized to fit within the inside surface 402 of anvil 400. The outside surface diameter of neck 512 of the puller is sized to fit within the inside surface diameter of the anvil collar 406. Puller 500 is moveable disposed within anvil 400 and the outside of puller 500 is in moveable mating engagement with the inside surface 402 of anvil 400.

The inside surface of the puller is a circumference with different surfaces and diameters. At the piston end 504, the inside surface of the puller has threads 521 for threaded engagement with threads on piston 14. The thread section threads onto the piston head, securing the puller to the piston. Threads 521 give way to smooth inside surface 520. The circumference size of inside surface 520 varies because the inside of puller 500 is not a hollow cylinder of the same diameter. Toward the piston end 504, the circumference of inside surface 520 is sized for moveable and mating engagement with the outside of the collet assembly. Moving toward the nose end 503, the inside surface 520 transitions to a slightly larger inside circumference, or bulge 522, then transitions to frustoconical taper 523, that transitions to stop lip 524, that transitions to inside surface 525 of neck 512. The outside surface of neck 512 fits within the inside circumference of collar 406 of anvil 400.

Figure 8:
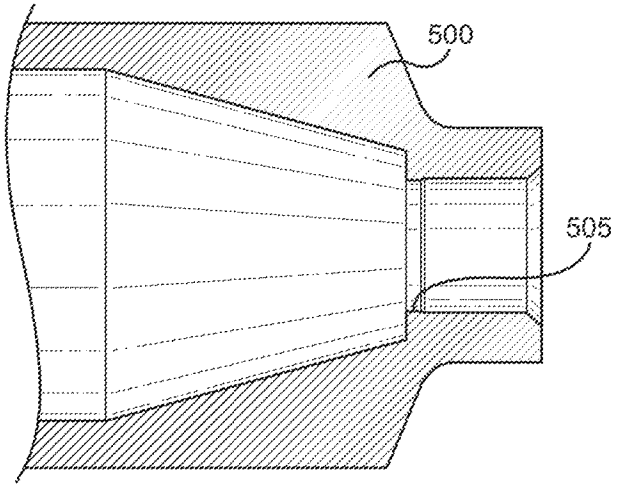
FIG. 8 is a close up cross-sectional view of the nose end of the puller, showing bump 505.

The neck 512 of puller 500 further comprises bump 505, shown in FIG. 8. Bump 505 prevents failed fasteners from being pulled inside the tool 10. In some cases, a fastener is defective or fails for other reasons, and the mushroom head breaks off, and the fastener may be pulled inside the tool and may cause damage to the tool, or may cause delay in work operations due to the time needed to remove the broken fastener from the tool. In these situations, bump 505 creates resistance that prevents a defective fastener from being pulled inside the tool.

The nose end 605 of the collet assembly rests on the lip 524 between the frustoconical section 523 and the neck 512 of puller 500.

Figure 6:
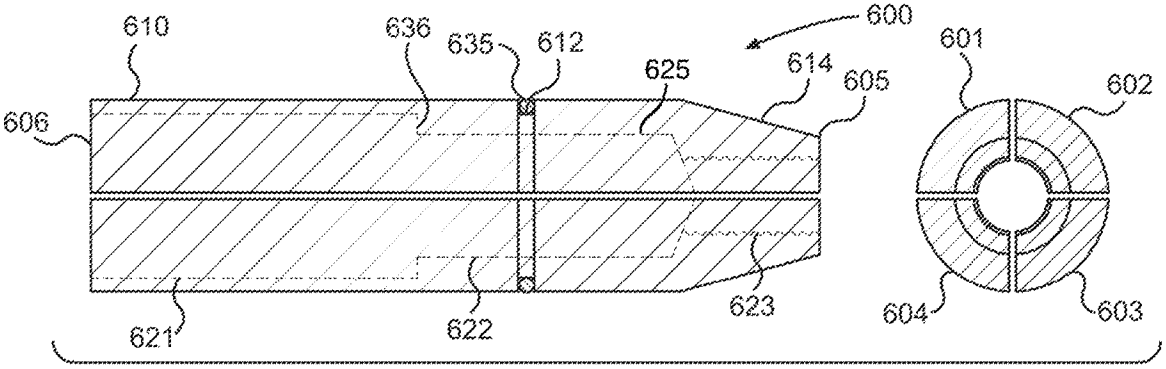
FIG. 6 is a view of the segmented collet, along with a front end view of the nose of the collet, with dotted lines showing an interior cross sectional view.

The collet assembly 600 is preferably formed by four separate segments, 601, 602, 603, and 604, shown in cross section in FIG. 6. It is apparent that the number of segments may be varied as needed or desired.

The collet segments are held together with at least one o-ring 635 located in a small groove 612 running around the outside circumference of each of the four collet segments. There is at least one o-ring 635 that corresponds with at least one groove 612.

The inside surface of each segment comprises three sections, a jaw section 623, a guide tube section 622, and a spring section 621. In the jaw sections 623, the inside circumference has a gripping surface comprised of grooves or teeth for gripping the fastener stem 21. In each segment a sloped rim 625 defines the boundary between the jaw section 623 and the guide tube section 622. In each segment, a straight rim 636 defines the boundary the guide tube section 622 and the spring section 621.

When bound together by o-ring 635, the circumferences of the segmented sections progressively increase, with the circumference of the segmented jaw sections being smaller than the circumference of the segmented guide tube sections, which is in turn smaller than the circumference than the segmented spring sections.

Figure 7:
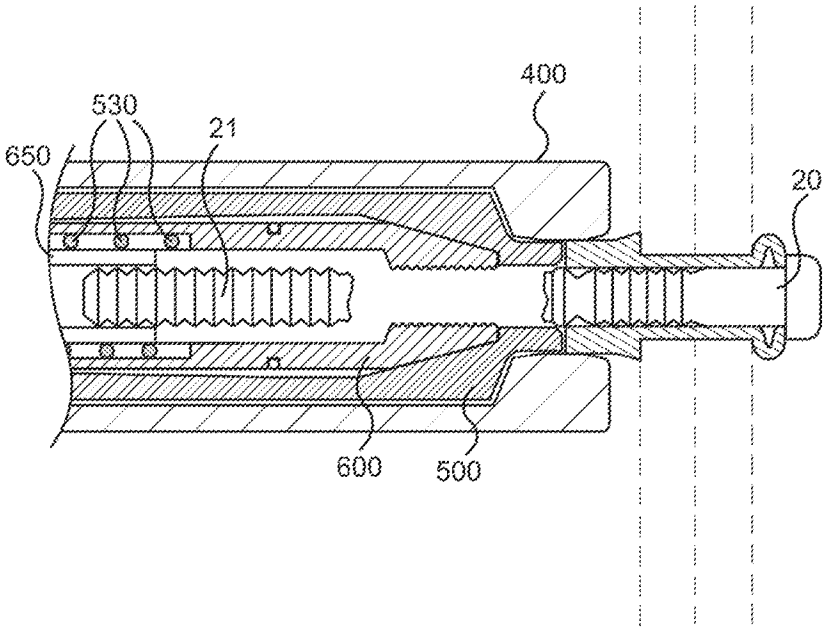
FIG. 7 is a cross section view of the tool during activation, showing the fastener stem broken away from the fastener, the mushroom head of the fastener, with the neck of the puller extruding the fastener.

Guide tube 651 is a hollow tube of generally pliable material. Guide tube 651 is sized to fit within the circumference defined by guide tube sections 622 when bound together by o-ring 635. Guide tube 651 is disposed inside spring 530. Guide tube 651 guides severed fastener stems 21 through the collet assembly, preventing the severed stems from getting caught on spring 530 or other internal components of the tool. As shown in FIG. 7, forces released propel stem 21 back toward the piston end of the tool, and severed fastener stem 21 is guided by guide tube 651 through the collet assembly to hollow channel 16 of piston 14.

Spring 530 is sized to fit within the circumference defined by spring sections 621 when bound together by o-ring 635. Spring 530 is disposed between guide tube 651 and the circumference defined by spring sections 621 when bound together by o-ring 635. Spring 530 has sufficient spring force to push collet assembly forward in the resting state, and to compress to allow the collet assembly to move back so that the collet jaws can open to receive a fastener stem at the start of the operation.

When bound together by o-ring 635 the outside segmented surfaces of collet 600 form a segmented column or circumference 610 that runs from the piston end 606 toward the nose end, whereupon the outside surface slopes 614 toward a nose end 605 of collet 600.

The nose end of the spring 530 rests against the rim 636 between spring sections 621 and guide tube sections 622.

Looking at the collet as a whole, with o-ring 635 in place, the collet 600 has a taper or slope 614 that corresponds with the frustoconical section 523 on the inside surface of the puller 500.

The nose edge 605 of each of the collet segment seats onto the lip 524 of puller 500.

In a preferred embodiment, there are four collet segments, each segment having the same configuration.

The spring 530 and guide tube 651 extend beyond the piston end of the collet, as shown in FIG. 1. The spring 530 may touch the piston 14, or may be close to touching the piston, preferably being between 0 and 4 millimeters away from the piston head. It is apparent that the spring may be touching the piston head, and may be further away from the piston head than 4 millimeters to achieve the desired effect, which is to dampen the forces.

The spring 530 is essential, and prevents the piston end of the collet segments from contacting the piston.

Figure 2:
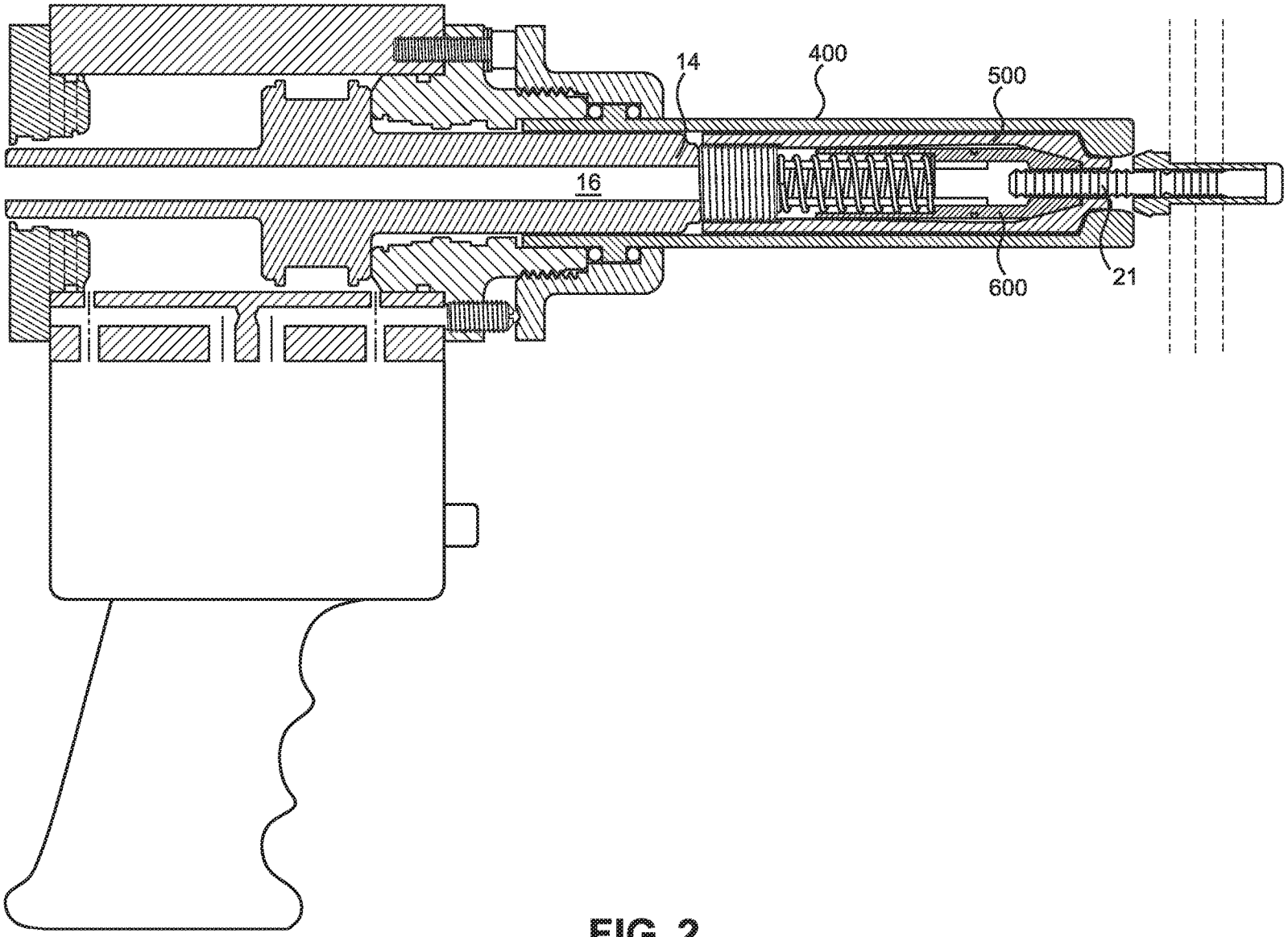
FIG. 2 is cross section of the tool prior to activation, showing the segmented jaws gripping a fastener stem, and the fastener connecting two work pieces shown by dotted lines.

In use, the tool is placed around the stem of a fastener. The widening inside surface circumference 520 of the puller 500 allows the collet to expand. Fastener stem 21 is inserted through and comes in contact with gripping jaws 623. This pushes the collet back slightly and the tapered head 614 of the collet expands into the wider space 522. This, along with four segments allows for easy insertion of the fastener stem. This creates less wear and tear on the gripping surface. After the collet assembly is pushed back and has gripped the fastener stem, the collet assembly moves forward to its resting position, gripping the fastener stem, as shown in FIG. 2.

Figure 3:
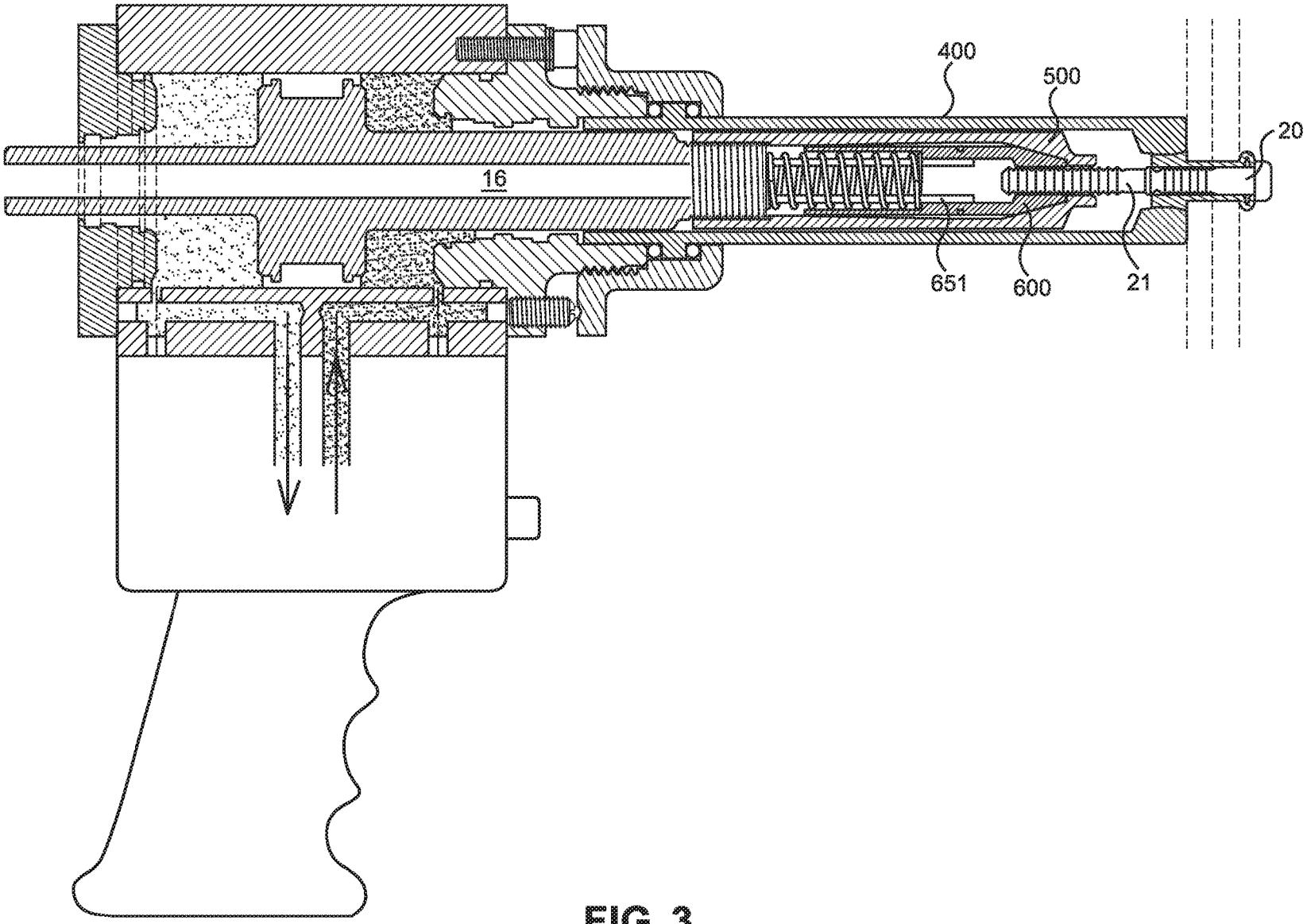
FIG. 3 is a cross section of the tool during activation, showing the segmented jaws pulling the fastener stem to the breaking point.

Trigger 12 activates the tool by activating the hydraulic power system. In operation, the nose end of the anvil rests on a workpiece, the collet jaws grip a fastener stem 21, the tool is activated, and high-pressure hydraulic fluid fills one chamber, causing the piston 14 to pull back, pulling the puller and collet assembly away from the head of the anvil. The hydraulic power system causes hydraulic fluid, show representationally in FIG. 3, to pull piston 14 back. As explained above, piston 14 and puller 500 are connected, and thus puller 500 is also pulled back. Rivet head, or fastener head begins to mushroom, or swage. FIG. 3 shows the fastener stem being stretched and pulled by the tool. This presses the taper 614 of collet 600 firmly against inside frustoconical section 523 of puller 500, compressing the jaw gripping surface 623 around the fastener stem 21. Lip 524 on inside of puller 500 firmly mates with nose end 605 of collet 600, pulling the collet back, and also stretching and pulling back fastener stem 21. The stem 21 is pulled back, mushrooming and swaging the rivet. Rivet stem 21 breaks, as shown in FIG. 8. Stem 21 is inside the guide tube 651 and will move toward the back of the tool due to the forces released when the fastener stem breaks.

Once sufficient force is exerted the fastener stem 21 breaks and the force released by breaking the stem causes the spring to compress and move backward. The broken stem moves through the collet assembly via the guide tube 651 to a hollow passageway 16 inside the piston 14. Ultimately the fastener stem is disposed of outside the tool.

After stem 21 breaks, the hydraulic liquid moves into another chamber and the puller 500 moves forward to its resting position. As the puller moves forward toward the nose of the tool, the puller neck 525 pushes the fastened workpiece with fastener 20 out and away from the tool.

A retaining collar 15 connects the anvil and entire nose assembly to the body of the tool. The retaining collar has a forward surface with annulus that is sized to receive the outside cylindrical surface 401 of anvil 400. The outside surface of the anvil has an annular ridge 408 with a o-ring 421 and 422 on each side of the ridge 408, wherein the ridge and o-rings have a larger circumference than the circumference of the annulus of retaining collar 15, thereby preventing the anvil from moving in or out of the retaining collar 15. The anvil ridge 408 and o-rings 421 and 422 are sized to fit within and correspond to an internal surface circumference of the retaining collar, as shown in FIG. 1. The internal surface of the retaining collar further comprises threaded grooves that thread onto the body 13 of the tool.

While implementations are described herein by way of example, the implementations are not limited to the examples or drawings described. And, the drawing figures are not necessarily to scale. Certain features or components herein may be shown in somewhat schematic form and some details of conventional elements may not be shown or described in the interest of clarity and conciseness.

It should be understood that the drawings and detailed description are not intended to limit implementations to the particular form disclosed but, on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

What is claimed is:

1. A hydraulic fastener tool comprising:

a tool body;

a trigger;

a hydraulic power system activated by pulling the trigger;

an anvil with an inside circumference and a nose end;

a retaining collar connecting the tool body with the anvil;

a piston disposed within the retaining collar, wherein the piston connects with a puller;

the puller movably disposed within the anvil and moveably connected with the inside circumference of the anvil, wherein the puller comprises a piston end, a nose end, a neck capable of pushing a fastened fastener out of the tool, an inside circumference comprising a bulge, a frustoconical taper, and a lip, and an external surface comprising a cylinder, and a shoulder;

a collet assembly moveably disposed within the puller, wherein a nose end of the collet assembly seats on the puller lip, the collet assembly comprising a spring, a guide tube, and segments bound by at least one o-ring, wherein the guide tube is within the spring and the guide tube guides a severed fastener stem rearward to a hollow passageway in the piston to dispose of the severed fastener stem outside the tool;

each segment of the collet assembly comprises a curved inside surface and an outside surface, wherein when all segments are bound by at least one o-ring the curved inside surfaces form a segmented circumference and the outside surfaces form a segmented circumference;

the inside segmented circumference comprising a jaw section that receives the fastener stem, a guide tube section that receives the guide tube, and a spring section that receives the spring;

the hydraulic power system, when activated, pulls the piston and puller rearward, breaking the fastener stem from the fastener, and the fastener stem moves rearward through the collet assembly, the guide tube, and the hollow passageway, and the fastener stem is disposed outside the tool, and wherein the hydraulic power system then moves the puller forward, and the puller neck pushes the fastened fastener out of the tool.

2. The tool of claim 1 wherein the segmented collet assembly comprises four segments.

3. The tool of claim 1 wherein the segmented collet assembly comprise more than four segments.

4. The tool of claim 1 wherein the segmented collet assembly comprises fewer than four segments.

5. The tool of claim 1 wherein the piston is in threaded connection with the puller.

6. The tool of claim 1 wherein the puller is a single unit puller.

7. The tool of claim 1 wherein the anvil further comprises longitudinal slots.

8. The tool of claim 1 wherein the puller nose end further comprises a bump to create resistance in case of fastener failure.

9. The tool of claim 1 wherein the collet assembly outside segmented circumference runs from a piston end of the collet assembly toward the nose end of the collet assembly whereupon the outside circumference slopes.

10. The tool of claim 9 wherein the collet assembly slope corresponds with the frustoconical taper on the puller.

11. The tool of claim 1 wherein the spring and the guide tube extend beyond the piston end of the collet assembly.

12. The tool of claim 1 wherein the spring further comprises a nose end that rests against a rim between the collet assembly spring section and guide tube section.

13. The tool of claim 1 wherein the nose end of the anvil rests on a workpiece, the collet assembly grips a fastener with a stem, the trigger activates the hydraulic power system pulling the piston, puller, collet assembly, and fastener stem rearward, while the nose end of the anvil remains resting on the workpiece, breaking the fastener stem from the fastener, the fastener stem moving rearward through the guide tube and the hollow passageway in the piston, and the hydraulic power system then causing the piston to move toward the nose end of the anvil, pushing the fastener out of the tool.

* * * * *